US008585500B2

(12) United States Patent
Smith et al.

(10) Patent No.: US 8,585,500 B2
(45) Date of Patent: Nov. 19, 2013

(54) GAME APPARATUS

(75) Inventors: Jessica Smith, LA, CA (US); Soon Park, Cypress, CA (US)

(73) Assignee: Mattel, Inc., El Segundo, CA (US)

( * ) Notice: Subject to any disclaimer, the term of this patent is extended or adjusted under 35 U.S.C. 154(b) by 626 days.

(21) Appl. No.: 12/629,765

(22) Filed: Dec. 2, 2009

(65) Prior Publication Data

US 2011/0130202 A1 Jun. 2, 2011

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.
USPC ..... 463/37; 463/35

(58) Field of Classification Search
USPC ..... 446/175; 463/30
See application file for complete search history.

(56) References Cited

U.S. PATENT DOCUMENTS

| | | | | |
|---|---|---|---|---|
| 4,363,482 | A | 12/1982 | Goldfarb | |
| 4,604,065 | A | 8/1986 | Frazer et al. | |
| 4,648,086 | A | 3/1987 | Koike | |
| 4,729,564 | A | 3/1988 | Kuna et al. | |
| 4,770,416 | A | 9/1988 | Shimizu et al. | |
| 4,799,678 | A | 1/1989 | Terzian et al. | |
| 4,846,480 | A | 7/1989 | Oliver | |
| 5,120,065 | A | 6/1992 | Driscoll et al. | |
| 5,285,437 | A * | 2/1994 | Yokota et al. | 369/64 |
| 5,314,336 | A | 5/1994 | Diamond et al. | |
| 5,331,141 | A | 7/1994 | Kaneko | |
| 5,334,022 | A | 8/1994 | Kitagawa et al. | |
| 5,411,259 | A | 5/1995 | Pearson et al. | |
| 5,478,240 | A | 12/1995 | Cogliano | |
| 5,482,277 | A | 1/1996 | Young | |
| 5,768,223 | A | 6/1998 | Li et al. | |
| 5,813,861 | A | 9/1998 | Wood | |
| 5,855,001 | A | 12/1998 | Doederlein et al. | |
| 5,906,492 | A | 5/1999 | Putterman | |
| 5,959,281 | A | 9/1999 | Domiteaux | |
| 6,089,943 | A | 7/2000 | Lo | |
| 6,179,682 | B1 * | 1/2001 | Plain et al. | 446/141 |

(Continued)

FOREIGN PATENT DOCUMENTS

| | | |
|---|---|---|
| GB | 2206287 | 1/1991 |
| GB | 2289423 | 9/1996 |

OTHER PUBLICATIONS

Amazon, LeapFrog2, http://www.amazon.com/Change-anyone-possible-change-names/forum/Fx1NES1XY8M3Z72/Tx35DL6DI2WH1ZC/1?_encoding=UTF8&asin=B00134PM71\, Created on Dec. 27, 2008.*
2004 Tyco Games—Talking Magic 8 Ball.

(Continued)

*Primary Examiner* — Omkar Deodhar
*Assistant Examiner* — Reginald Renwick
(74) *Attorney, Agent, or Firm* — Kolisch Hartwell, PC

(57) ABSTRACT

A game apparatus that includes a processor, a microphone, a memory, a speaker, and an audio playback actuator. The memory stores a first plurality of audio messages, each corresponding to an audio input received by the microphone, and a second plurality of pre-recorded audio messages. The audio playback actuator causes the processor to randomly select a first audio message from the first plurality of audio messages and a second audio message from the second plurality of pre-recorded audio messages, and to play the first and second audio messages through the speaker.

22 Claims, 2 Drawing Sheets

(56) References Cited

U.S. PATENT DOCUMENTS

| | | | | |
|---|---|---|---|---|
| 6,182,966 | B1 | 2/2001 | Wells et al. | |
| 6,273,421 | B1 | 8/2001 | Thalheimer et al. | |
| 6,292,780 | B1 * | 9/2001 | Doederlein et al. | 704/270 |
| 6,368,176 | B1 | 4/2002 | Lozowski et al. | |
| 6,439,723 | B1 | 8/2002 | Tano | |
| 6,659,835 | B1 | 12/2003 | Allen | |
| 6,905,391 | B2 | 6/2005 | Soto et al. | |
| 7,033,243 | B2 | 4/2006 | Hornsby et al. | |
| 7,044,857 | B1 | 5/2006 | Klitsner et al. | |
| 7,410,170 | B1 | 8/2008 | Roach et al. | |
| 2002/0137012 | A1 | 9/2002 | Hohl | |
| 2005/0137004 | A1 | 6/2005 | Wood | |
| 2005/0212202 | A1 | 9/2005 | Meyer | |
| 2006/0040748 | A1 | 2/2006 | Barthold | |
| 2006/0166173 | A1 | 7/2006 | Ellis | |
| 2006/0170158 | A1 | 8/2006 | MacIver | |
| 2006/0228983 | A1 | 10/2006 | Carthern | |
| 2007/0026919 | A1 * | 2/2007 | Klitsner et al. | 463/7 |
| 2008/0132304 | A1 | 6/2008 | Fleury | |
| 2008/0252007 | A1 | 10/2008 | Baker | |
| 2008/0254846 | A1 | 10/2008 | Magers | |
| 2009/0286604 | A1 * | 11/2009 | Clowes et al. | 463/42 |
| 2009/0315257 | A1 * | 12/2009 | Blumenstock et al. | 273/237 |

OTHER PUBLICATIONS

Korean Intellectual Property Office, International Search Report for Application No. PCT/US2010/058564, Aug. 30, 2011, 3 pages.

Korean Intellectual Property Office, Written Opinion of the International Searching Authority for Application No. PCT/US2010/058564, Aug. 30, 2011, 3 pages.

Korean Intellectual Property Office, International Preliminary Report on Patentability for PCT Application No. PCT/US2010/058564, Jun. 14, 2012, 8 pages.

European Patent Office, Office Action for European Patent Application No. 10835054.7, May 23, 2013, 6 pages.

Canadian Intellectual Property Office, Office Action for Canadian Patent Application No. 2782305, Jun. 28, 2013, 3 pages.

* cited by examiner

GAME APPARATUS

BACKGROUND

The present disclosure relates to electronic game apparatus for recording and playing audio messages during game play. Examples of electronic game apparatus can be found in U.S. Pat. Nos. 4,729,564, 4,770,416, 4,846,480, and 5,120,065, and U.S. Patent Application No. US20050137004. The disclosures of these and all other publications referenced herein are incorporated by reference in their entirety for all purposes.

The advantages of the present invention will be understood more readily after a consideration of the drawings and the Detailed Description.

DETAILED DESCRIPTION

Figure 1:
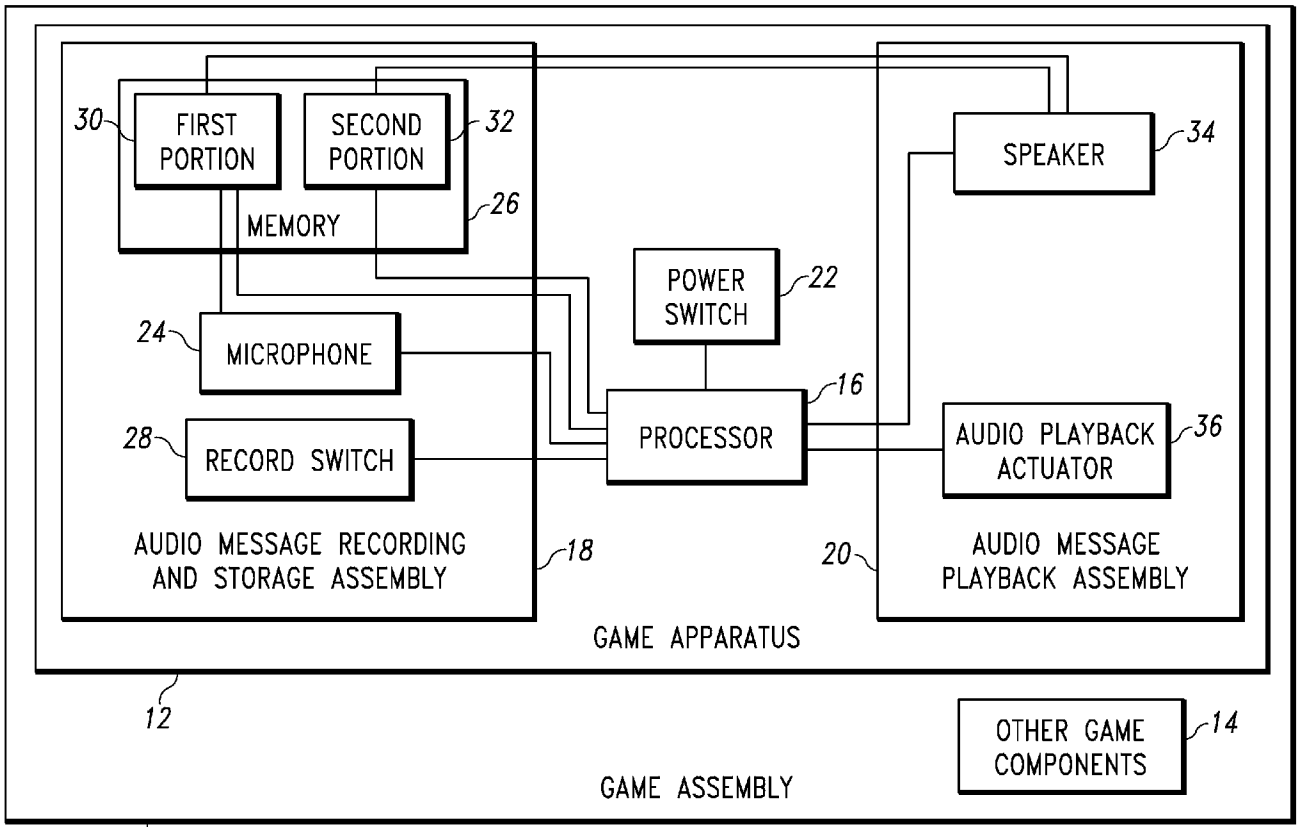
FIG. 1 is a block diagram of a game assembly that includes a game apparatus according to aspects of the present disclosure.

Game apparatus are disclosed herein that can be used to play a variety of different games. FIG. 1 is a block diagram generally depicting a game 10 that includes a game apparatus 12 and other game components 14. Game apparatus 12 may be an electronic game apparatus for recording and playing audio messages during game play. Other game components 14 may include any number of game boards, game tokens, playing cards, and/or any other known or hereinafter devised game components. The game apparatus and other game components can be made of any suitable materials consistent with their functions.

Game apparatus 12 may include a processor 16, an audio message recording/storage assembly 18, an audio message playback assembly 20, and/or a power switch 22.

Processor 16 (or controller) may include any number of discrete components, and may be adapted to receive, process, direct, and/or send signals in a manner that controls the other components of the game apparatus. As such, the processor may be connected to each of the various components of the audio message recording/storage assembly 18 and the audio message playback assembly 20. The processor also may be connected to the power switch 22, which can be used to selectively power the various components of the game apparatus according to known methods, such as with a battery or other power source (not shown).

The audio message recording/storage assembly 18 may include a microphone 24, a memory 26, and a record switch 28. Microphone 24 may be connected to processor 16 and memory 26, and may be adapted to receive/detect audio input.

Memory 26 may be connected to the processor, microphone and/or speaker, and may be adapted to store a plurality of audio messages, including a plurality of re-recordable audio messages, and a plurality of pre-recorded and/or non-modifiable audio messages. For example, the memory may include a first portion 30 and a second portion 32. First portion 30 may be adapted to store a first plurality of re-recordable audio messages, each corresponding to an audio input received by microphone 24. As such, the first portion may be connected to the microphone. Second portion 32 may be adapted to store a second plurality of pre-recorded and/or non-modifiable audio messages. In some embodiments, the second portion may be incapable of storing any audio messages corresponding to audio inputs received by the microphone. In such embodiments, the second portion may not be connected to the microphone. However, it should be appreciated by one of skill in the art that the first and second portions of the memory need not be physically separate or apportioned, but instead, each merely may be a portion of the memory dedicated to storing either re-recordable audio messages, or pre-recorded audio messages, respectively, and as such, the second portion may be physically connected to the microphone.

Record switch 28 may be connected to processor 16, and may be adapted to cause the processor to cause microphone 24 to receive one or more audio inputs, whereupon each of the one or more audio inputs is stored in memory 26 (such as first portion 30 of the memory) as a corresponding one of the plurality of re-recordable audio messages. In some embodiments, when the record switch is used to record audio messages into the first portion of the memory, any re-recordable audio messages that were stored in the first portion of the memory prior to using the record switch may be removed from the memory. In some cases, the record switch, when used, may cause the processor to cause the speaker 34 to play pre-recorded audio messages that prompt a user through the process of recording re-recordable audio messages into the memory (such as into the first portion of the memory). The record switch also may not be usable to cause game apparatus 12 to alter the pre-recorded audio messages stored in the memory (such as those stored in the second portion of the memory).

Audio playback assembly 20 may include speaker 34 and audio playback actuator 36. The speaker may be connected to processor 16 and memory 26, and may be adapted to play audio messages stored in the memory in an audible manner. Likewise, audio playback actuator 36 may be connected to the processor, and upon actuation, may be adapted to cause the processor to cause the speaker to play audio messages stored in the memory in an audible manner. For example, the audio playback actuator may be adapted to receive a selection input from a user (as discussed in more detail below), thereby causing the processor to select randomly a first audio message from the plurality of re-recordable audio messages stored in the memory (such as those stored in first portion 30), and a second audio message from the plurality of pre-recorded audio messages stored in the memory (such as those stored in second portion 32). The processor then sequentially may play the first and second audio messages through the speaker.

Figure 2:
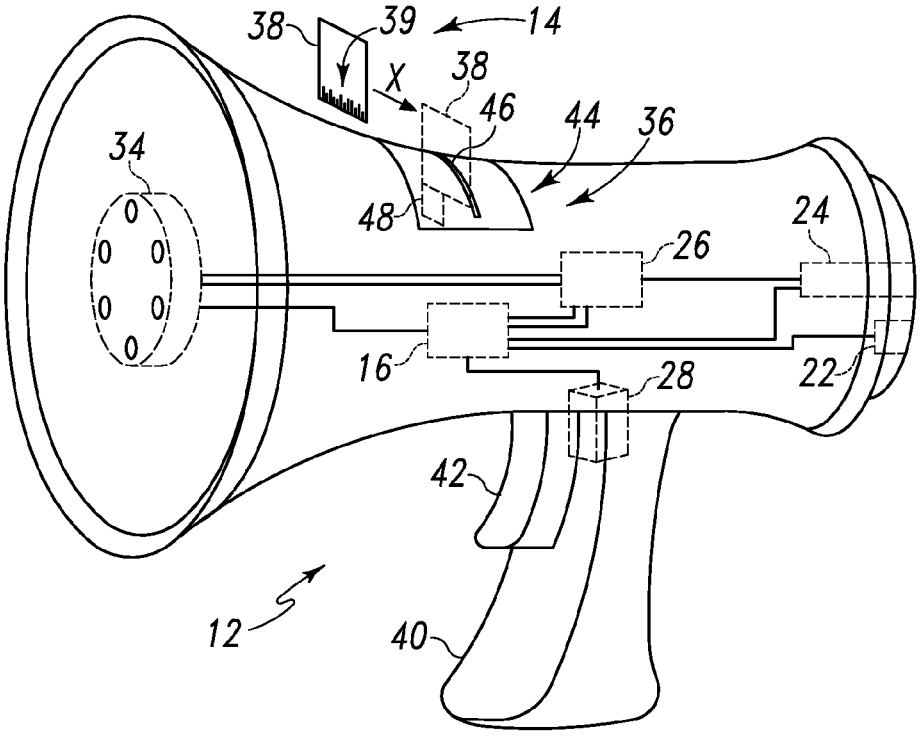
FIG. 2 is perspective view of a game assembly that includes a game apparatus and a playing card according to aspects of the present disclosure.
Figure 3:
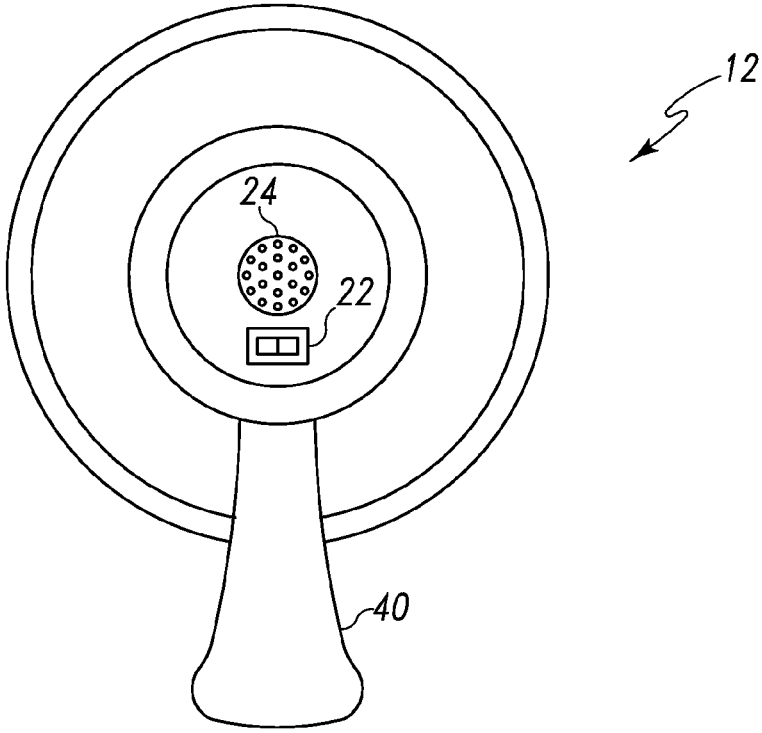
FIG. 3 is rear view of a game apparatus according to aspects of the present disclosure.

FIGS. 2 and 3 show an exemplary embodiment of game assembly 10 that includes game apparatus 12 and another game component 14 that comprises a playing card 38, although it should be appreciated that game 10 may include other game components, such as additional playing cards, game tokens, a game board, etc. As discussed above, game apparatus 12 may include processor 16, power switch 22, microphone 24, memory 26, record switch 28, speaker 34, and audio playback actuator 36, and each of these components may have structures and functions substantially as described above and/or below. Game apparatus 12 may have any size and shape consistent with its function, and may be designed to look like some non-game related physical object, so as to increase play value. For example, game apparatus 12 may be shaped like a bullhorn that includes a handle 40 and a trigger 42. The trigger may be used to actuate record switch 28, which in turn may cause processor 16 to cause microphone 24 to detect audio input that is recorded in memory 26 (such as into first portion 30).

Audio playback actuator 36 of game apparatus 12 may be adapted to receive a selection input from a user, thereby actuating the audio playback actuator. For example, in some embodiments, the audio playback actuator may include a button (not shown) or trigger 42 that may be pressed or squeezed by a user to actuate the audio playback actuator. Alternatively or additionally, the audio playback actuator may be actuated by an additional game component, such as playing card 38. For example, as shown in FIGS. 2 and 3, the audio playback actuator may include a card receiver 44 having a slot 46 dimensioned to receive the playing card, and a switch 48 disposed within the slot. The audio playback actuator may receive a selection input from a user when the user inserts the card into the slot or slides the card through the slot, such as along direction X, whereupon the card may engage and trigger the switch to actuate the audio playback actuator. The switch may be a mechanical switch that can only be engaged and actuated by an object capable of fitting into the slot (such as playing card 38). Alternatively, the switch may be more accessible to the user and/or other game objects, depending on the dimensions (e.g. width) of the slot, and the depth at which the switch is positioned within the slot. In some embodiments, in lieu of or in addition to switch 38, card receiver 44 may include a card scanner disposed within the card receiver for scanning encoded information 39 (e.g. info encoded in a barcode, magnetic strip, watermark, or other encoded information now known or later devised) associated with playing card 38, and for transmitting to the processor a signal corresponding to the information. In such embodiments, when the processor receives the signal, the processor may randomly select and cause the speaker to play one of the re-recordable audio messages and one of the pre-recorded and/or non-modifiable audio messages.

In some embodiments, game apparatus 12 may further include a mode switch (not shown) for selectively configuring the device in an audio record or an audio playback mode. For example, the mode switch may include a record setting and an audio playback setting. When the mode switch is in the record setting, the game apparatus may record audio input as audio messages when record switch 28 is actuated (e.g., by pulling trigger 42), but may not play audio messages when audio playback actuator 36 is actuated (e.g., by sliding the card 38 through the card receiver 44). In contrast, when the mode switch is in the audio playback setting, the game apparatus may play audio messages when the audio playback actuator is actuated, but may not record audio input as audio messages when the record switch is actuated.

Game apparatus 12 disclosed herein can be used to play any number of games. For example, the game apparatus may be used to play a variation of the UNO® card game, where certain specialized cards indicate to the players that they should actuate the audio playback actuator on the game apparatus. These cards may, for example, be a unique form of a wildcard (e.g., "bullhorn" wildcards). Memory 26 (such as second portion 32 of the memory) may store a plurality of pre-recorded audio messages relating to game play. For example, the audio messages, when played on speaker 34, may audibly instruct the performance of an action or penalty related to the game, such as the Reverse, Skip, or Draw Four instructions. Memory 26 (such as first portion 30 of the memory) also may store a plurality of re-recorded audio messages relating to game play. For example, each re-recorded audio messages may identify one of the players of the game, such as by name or nickname. To store the plurality of re-recorded audio messages in the memory, prior to game play, record switch 28 of the audio message recording and storage assembly 18 may be used to store a plurality of audio messages, each corresponding to an identification (e.g., a name or nickname) of one of the players, into memory 26 (such as into first portion 30).

Game play associated with such a variation of UNO® may be identical to the card game UNO®, with the exception of the specialized wildcards (e.g., the "bullhorn" wildcards) and the manner in which those wildcards are used. If a player discards/plays one of the specialized wildcards, then the player may be required to actuate audio playback actuator 36 on game apparatus 12, such as by sliding the specialized wildcard through slot 46. Upon actuation of the audio playback actuator, processor 16 may randomly select a first audio message from the plurality of re-recordable audio messages (e.g., the name of one of the players) and a second audio message from the plurality of pre-recorded audio messages (e.g., an instruction to perform an action), and may cause the speaker to play the first and second audio messages as a composite audio message. The composite audio message may be an instruction to one of the players to perform a particular action (e.g., "Mom Draw Four").

Sample rules for the game are as follows.

Uno® classic card game goes revolutionary! Whenever you play an action card, you must grab the bullhorn, put the card in the bullhorn and see who gets the penalty.

Contents:

1 Bullhorn 108 cards as follows:

19 Blue cards—0-9

19 Green cards—0-9

19 Red cards—0-9

19 Yellow cards—0-9

8 Draw 2 cards—2 each in blue, green, red and yellow

8 Reverse cards—2 each in blue, green, red and yellow

8 Skip cards—2 each in blue, green, red and yellow

8 Bullhorn cards

The Object

Be the first player to score 500 points. Points are scored by getting rid of all the cards in your hand before your opponent (s). You score points for cards left in your opponents' hands.

Game Play

Game Set-Up

Take the bullhorn and press the record button while saying someone's name. Release the record button when you are done saying the name. Repeat until all the players names are in the bullhorn.

Each player draws a card.

The person who draws the highest number deals.

Once the cards are shuffled each player is dealt 7 cards.

The remainder of the deck is placed facedown in the center to form a DRAW pile.

The top card of the DRAW pile is turned over to begin a DISCARD pile, also in the center of the play area.

Let's Play!

The person to the left of the dealer starts play.

The player taking their turn has to match the card on the DISCARD pile, either by number, color or symbol. For example, if the card is a red 7, the player must put down a red card on any color seven. Alternatively, the player can put down a Wild card (See FUNCTIONS OF ACTION CARDS).

If the player doesn't have a card to match the one on the DISCARD pile, they must take a card from the DRAW pile. If the card picked up can be played, the player is free to put it down in the same turn. Otherwise, play moves on to the next person in turn.

Players may choose not to play a playable card from their hand. If so, the player must draw a card from the DRAW pile. If playable, the card just drawn can be played immediately, but that player may not play a card that was already in their hand prior to the draw.

If a player discards a bullhorn card, see Action cards for next steps.

When a player is down to one card, they must yell "UNO!" before another player does so. If they are caught having UNO by another player, they must draw 2 cards.

First Player to use all of the cards in their hand wins!

Functions of the Action Cards

Reverse Card: Reverses direction of play. Play changes direction to the right, and vice versa. The card may only be played on a matching color or on another Reverse card. If this card is turned up at the beginning of play, the dealer goes first, and then play moves to the right instead of the left.

Skip Card: The next player in turn after this card has been played loses their turn and is "skipped." The card may only be played on a matching color or on another Skip card. If a Skip card is turned up at the beginning of play, the player to the left of the dealer is "skipped," hence the player to the left of that player commences play.

Bullhorn card—place the Bullhorn wild card in the bullhorn and wait for the bullhorn to randomly pick a pre-recorded name and an action. Ex. (Mom+Draw 2) Actions will be discard 1-4

The exemplary embodiments and methods illustrated and disclosed herein are believed to encompass multiple distinct inventions with independent utility. While each has been disclosed in an exemplary form, the specific embodiments thereof as disclosed and illustrated herein are not to be considered in a limiting sense, as numerous variations of the concepts and components are possible. The subject matter of the inventions includes all novel and non-obvious combinations and subcombinations of the various elements, features, functions and/or properties disclosed herein. Where any description recites "a" or "a first" element or the equivalent thereof, such description should be understood to include incorporation of one or more such elements, neither requiring nor excluding two or more such elements.

What is claimed is:

1. A game apparatus, comprising:
a processor;
a microphone;
a memory for storing:
a first plurality of audio messages, each corresponding to an audio input received by the microphone, and
a second plurality of pre-recorded audio messages;
a speaker; and
an audio playback actuator;
wherein the audio playback actuator includes:
a card receiver dimensioned to receive a playing card;
and a switch disposed within the card receiver, so that inserting the playing card into the card receiver causes the playing card to engage the switch and actuate the audio playback actuator; and
when actuated, the audio playback actuator causes the processor:
to select randomly a first audio message from the first plurality of audio messages and a second audio message from the second plurality of pre-recorded audio messages; and
to sequentially play the first and second audio messages through the speaker.

2. The game apparatus of claim 1, wherein the memory includes a first portion for storing the first plurality of audio messages and a second portion for storing the second plurality of audio messages.

3. The game apparatus of claim 2, wherein the second portion of the memory is incapable of storing audio messages corresponding to audio inputs received by the microphone.

4. The game apparatus of claim 2, further comprising a record switch that, when used, causes the microphone to receive one or more audio inputs, whereupon:
each of the one or more audio inputs is stored in the first portion of the memory as a corresponding one of the first plurality of audio messages; and
any audio messages that were stored in the first portion of the memory prior to using the record switch are removed from the memory.

5. The game apparatus of claim 4, wherein the record switch cannot be used to alter any of the pre-recorded audio messages stored in the second portion of the memory.

6. The game apparatus of claim 1, wherein the
playing card is independent of and includes no components of the game apparatus.

7. The game apparatus of claim 6, wherein the card receiver includes a slot, and the switch can only be actuated by an object capable of being inserted into the slot.

8. The game apparatus of claim 1, wherein the audio playback actuator includes a card scanner for scanning information associated with a playing card, and for transmitting to the processor a signal corresponding to the information.

9. The game apparatus of claim 8, wherein the information associated with the playing card is encoded, and the processor decodes the information.

10. The game apparatus of claim 1, wherein each of the first plurality of audio messages corresponds to an identifier for a user of the game apparatus.

11. The game apparatus of claim 1, wherein each of the plurality of second audio messages corresponds to an instruction to perform a game action.

12. A game apparatus, comprising:
a processor;
an audio message recording and storage assembly for recording and storing a first plurality of user-recorded audio messages, and for storing a second plurality of pre-recorded audio messages; and
an audio message playback assembly, including:
a speaker; and
an audio playback actuator including;
a card receiver dimensioned to receive a playing card; and
a mechanical switch disposed within the card receiver, so that inserting the playing card into the card receiver causes the playing card to engage the mechanical switch and actuate the audio playback actuator;
wherein when actuated, the audio playback actuator causes the processor to randomly select and sequentially play on the speaker one of the first plurality of audio messages and one of the second plurality of pre-recorded audio messages.

13. The game apparatus of claim 12, wherein the audio message recording and storage assembly includes:
a memory having a first portion for storing the first plurality of audio messages and a second portion for storing the second plurality of audio messages; and
a record switch that, when used, causes the audio message recording and storage assembly to receive one or more audio inputs, whereupon:

each of the one or more audio inputs is stored in the first portion of the memory as a corresponding one of the first plurality of audio messages; and any audio messages that were stored in the first portion of the memory prior to using the record switch are removed from the memory.

14. The game apparatus of claim 12, wherein the audio message recording and storage assembly cannot be used to alter any of the second plurality of pre-recorded audio messages.

15. The game apparatus of claim 12, wherein the playing card is independent of and includes no components of the game apparatus.

16. The game apparatus of claim 12, wherein the actuator includes a card scanner for scanning information associated with a playing card, and for transmitting to the processor a signal corresponding to the information.

17. The game apparatus of claim 16, wherein the information associated with the playing card is encoded, and the processor decodes the information.

18. A game apparatus, comprising:

an audio message recording and storage assembly for recording and storing a first plurality of user-recorded audio messages, and for storing a second plurality of pre-recorded audio messages;

an audio message playback assembly for receiving a selection input from a user; and an audio playback actuator that includes:

a card receiver dimensioned to receive a playing card; and a mechanical switch disposed within the card receiver, so that inserting the playing card into the card receiver causes the playing card to engage the mechanical switch and actuate the audio message playback assembly, whereupon the audio playback assembly randomly selects a first audio message from the first plurality of audio messages and a second audio message from the second plurality of pre-recorded audio messages and sequentially plays the first and second audio messages in an audible manner.

19. The game apparatus of claim 18, wherein the audio message recording and storage assembly includes:

a memory having a first portion for storing the first plurality of audio messages and a second portion for storing the second plurality of audio messages; and a record switch that, when used, causes the audio message recording and storage assembly to receive a plurality of audio inputs, whereupon:

each of the plurality of audio inputs is stored in the first portion of the memory as a corresponding one of the first plurality of audio messages; and any audio messages that were stored in the first portion of the memory prior to using the record switch are removed from the memory.

20. The game apparatus of claim 18, wherein the audio message recording and storage assembly cannot be used to alter any of the second plurality of pre-recorded audio messages.

21. The game apparatus of claim 18, wherein the playing card is independent of and includes no components of the game apparatus.

22. The game apparatus of claim 18, wherein the actuator includes a card scanner for scanning information associated with a playing card, and for transmitting to the processor a signal corresponding to the information.

* * * * *